US007997925B2

(12) United States Patent
Lam et al.

(10) Patent No.: US 7,997,925 B2
(45) Date of Patent: Aug. 16, 2011

(54) MULTIFUNCTIONAL WALL SOCKET

(76) Inventors: Chung Man Lam, Hong Kong (HK); Kwan Mo Ng, Hong Kong (HK); Tak On Chan, Hong Kong (HK)

( * ) Notice: Subject to any disclaimer, the term of this patent is extended or adjusted under 35 U.S.C. 154(b) by 218 days.

(21) Appl. No.: 12/514,528

(22) PCT Filed: May 27, 2008

(86) PCT No.: PCT/CN2008/001028

§ 371 (c)(1),
(2), (4) Date: May 12, 2009

(87) PCT Pub. No.: WO2008/151506

PCT Pub. Date: Dec. 18, 2008

(65) Prior Publication Data

US 2010/0029109 A1 Feb. 4, 2010

(30) Foreign Application Priority Data

Jun. 8, 2007 (CN) ..... 2007 1 0074848

(51) Int. Cl.
*H01R 13/60* (2006.01)

(52) U.S. Cl. ..... 439/535; 439/536; 174/66; 363/146

(58) Field of Classification Search ..... 439/535–536, 439/131, 136, 141–142, 602.21; 174/66–67, 174/53; 363/142–144, 146, 84
See application file for complete search history.

(56) References Cited

U.S. PATENT DOCUMENTS

| | | | | |
|---|---|---|---|---|
| 6,362,987 | B1 * | 3/2002 | Yurek et al. | 363/146 |
| 6,943,296 | B2 * | 9/2005 | Perrella et al. | 174/66 |
| 7,140,922 | B2 * | 11/2006 | Luu et al. | 439/651 |
| 7,642,457 | B2 * | 1/2010 | Weeks et al. | 174/53 |
| 2008/0012423 | A1 | 1/2008 | Mimran | |
| 2009/0315509 | A1 | 12/2009 | Wu | |

FOREIGN PATENT DOCUMENTS

| | | | |
|---|---|---|---|
| CN | 2169930 | Y | 6/1994 |
| CN | 2494048 | Y | 5/2002 |
| CN | 2514389 | Y | 10/2002 |
| CN | 1473389 | A | 2/2004 |
| CN | 2742601 | Y | 11/2005 |
| CN | 2793978 | Y | 7/2006 |
| CN | 2872666 | Y | 2/2007 |

* cited by examiner

*Primary Examiner* — Xuong Chung Trans

(57) ABSTRACT

A multifunctional wall socket related to electrical conduction connecting device, comprising socket cover (1) with a conventional power connector (2) and a USB port (3) arranged on the socket cover. The USB port (3) is connected to the output terminals of an AC-DC conversion module (4) arranged on the socket cover (1). The AC-DC conversion module (4) comprises a rectifier filter module (41), modulation step-down module (42), current sampling and protection module (43), voltage reference module (44) and feedback control module (45). A first safety shutter (6) which can be opened or closed in arranged at the USB port (3) on the socket cover (1), or a second safety shutter (7) which can be opened or closed is arranged at the conventional power connector (2).

8 Claims, 8 Drawing Sheets

MULTIFUNCTIONAL WALL SOCKET

TECHNICAL FIELD

The claimed invention relates to a connection device for electrical conduction, particularly to a multifunctional wall socket.

BACKGROUND ART

Existing sockets, as shown in FIG. 1A, generally include a socket cover 1. The socket cover 1 has conventional power connectors 21', 22'. The conventional power connectors 21', 22' are used for connecting to AC (Alternate Current) line power, wherein the conventional power connector 22' include two live holes. In comparison with the conventional power connector 22', the conventional power connector 21' further includes an earth hole. The socket can be mounted onto a wall. As shown in FIG. 1B, a conventional power connector 21' is also included in the prior art. This conventional power connector 21' is different from the conventional power connector 21' as shown in FIG. 1A only by a certain difference in the shape of the connector, but the principles are the same.

Most existing sockets are solely used to provide AC line power connectors. The functions are relatively limited.

SUMMARY OF THE INVENTION

The objective of the claimed invention is to provide a multifunctional wall socket to supplement the shortcomings in the existing socket technology which has relatively limited functions, as most existing sockets are solely used to provide AC line power connectors.

The multifunctional wall socket implemented by the claimed invention comprises a socket cover, the socket cover including conventional power connectors, the conventional power connectors being used for connecting to AC line power, wherein: a USB port is further arranged in said socket cover, an AC-DC (Alternate Current-Direct Current) conversion module is arranged in said socket cover, said AC-DC conversion module being connected to the AC line power connector with an output terminal outputting DC (Direct Current) and connecting to the USB port.

Said AC-DC conversion module may comprise a rectifier filter module, a modulation step-down module, a current sampling and protection module, a voltage reference module and a feedback control module, the rectifier filter module and modulation step-down module being connected to each other in sequence, the current sampling and protection module and the voltage reference module being connected to the feedback control module, and the output of the feedback control module is connected to the modulation step-down module, wherein, said rectifier filter module performs rectification and filtering processing on the AC input, generating coarsely-adjusted DC to output to the modulation step-down module;

said modulation step-down module generates a modulation signal through a transformer and a switching chip, outputting a secondary DC voltage to the current sampling and protection module and the voltage reference module after rectification and filtering;

said current sampling and protection module acquires a feedback current, and transmits an over-current signal to the feedback control module, to control feedback current parameters;

said voltage reference module transmits a voltage signal to the feedback control module, outputting a DC voltage in conformity with the electrical parameters of the standard USB port through the voltage reference module and the feedback control module;

said feedback control module feeds back current control signal and voltage control signal to the modulation step-down module.

Indicator lights may be further arranged on said socket cover, said indicator lights show the working status of said AC-DC conversion module.

A first safety shutter which can be opened or closed may be located at the USB port on said socket cover.

Said first safety shutter may comprise a base, a bow-shaped spring, a slide cover, a pair of inwardly concave grooved block corresponding to the slide cover, and a USB slot provided on the socket cover, wherein, the USB port is installed on said base, said base being docketed in the socket cover;

said inwardly concave grooved blocks are arranged on two sides of the base, the slide cover being installed between the two inwardly concave grooved blocks;

said bow-shaped spring is mounted at a side of the base with an end pushing against a side end of the slide cover;

said USB slot corresponds to the location of the USB port and the slide cover.

A stopper bar may be arranged outside an end of said slide cover with said stopper bar leaning against the edge of the USB slot.

A second safety shutter which can be opened or closed may be arranged at the location of the conventional power connector in said socket plate.

Said second safety shutter may comprise a slide corresponding to the earth hole, and a linear spring biased against the said slide, wherein, an opening is provided in the middle of said slide, said opening corresponding to the earth hole of the conventional power connector;

said slide can cover the live holes of the conventional power connector;

after an external pin is inserted into the earth hole and the opening, said slide displaces laterally away from the location of the live holes.

The slide may include a main body, wherein,

An oblique opening is provided in the middle of said main body;

one end of said main body is attached with an protruding rod, the linear spring may be fitted onto the protruding rod;

wings are attached on both sides of the other end of the main body, said two wings being located at the two live holes of the conventional power connector.

The beneficial effects of this invention are: in the claimed invention, a USB port is further arranged in a socket cover, a AC-DC conversion module is arranged in said socket cover, the input terminals of the AC-DC conversion module is connected to the AC line power with its output terminals outputting DC power and connecting with the USB port so that the USB port on the socket cover can be used as the charging port for electrical appliances (with USB plug), increasing the functions of the socket.

In the claimed invention, a first safety shutter which can be opened or closed is arranged at the USB port on the socket cover, and a second safety shutter which can be opened or closed is arranged in a conventional power connector in the socket cover. This can prevent accidental electric shock or damage (for example, if a child puts a foreign material into a USB port or conventional power connector out of their curiosity), to further enhance the safety of the claimed invention.

DETAILED DESCRIPTION OF THE INVENTION

Figure 1A:
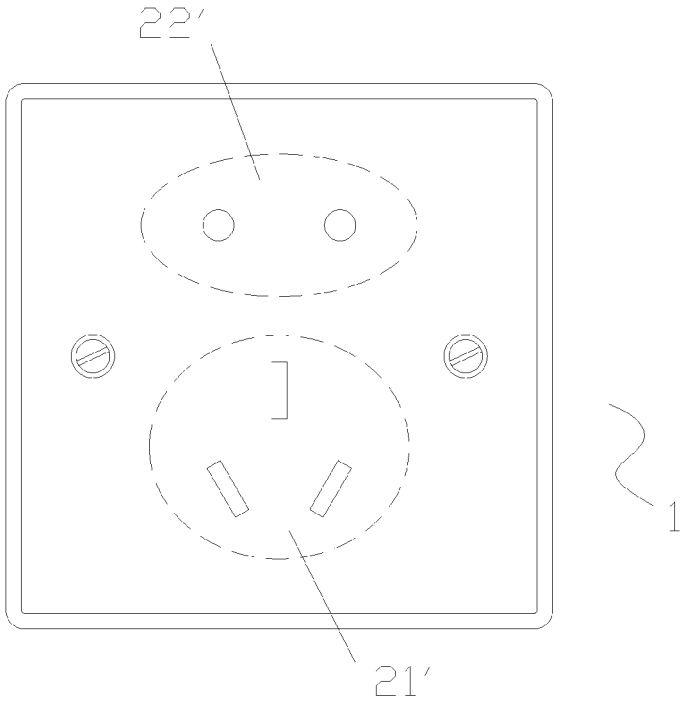
FIG. 1A is a schematic drawing for the design of a socket in the existing technology.
Figure 1B:
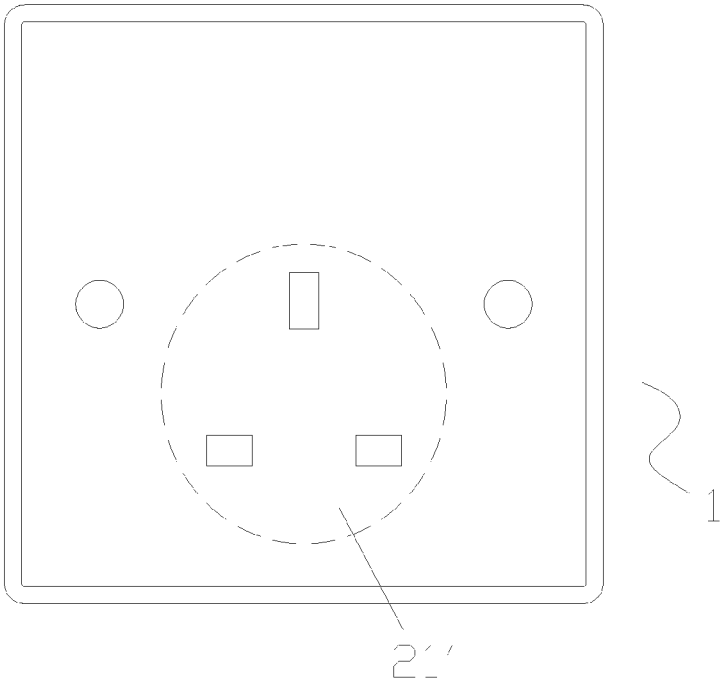
FIG. 1B is a schematic drawing for the design of another socket in the existing technology.
Figure 2:
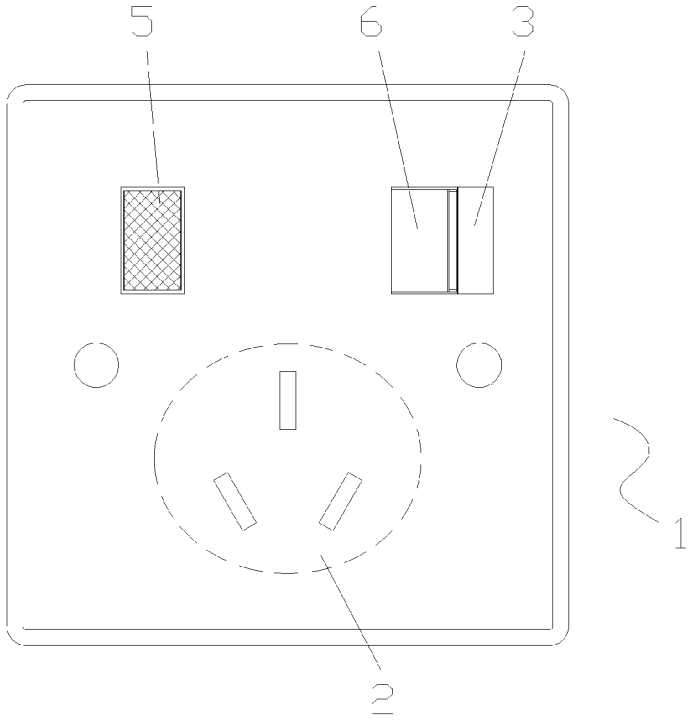
FIG. 2 is a schematic drawing for the claimed invention.
Figure 3:
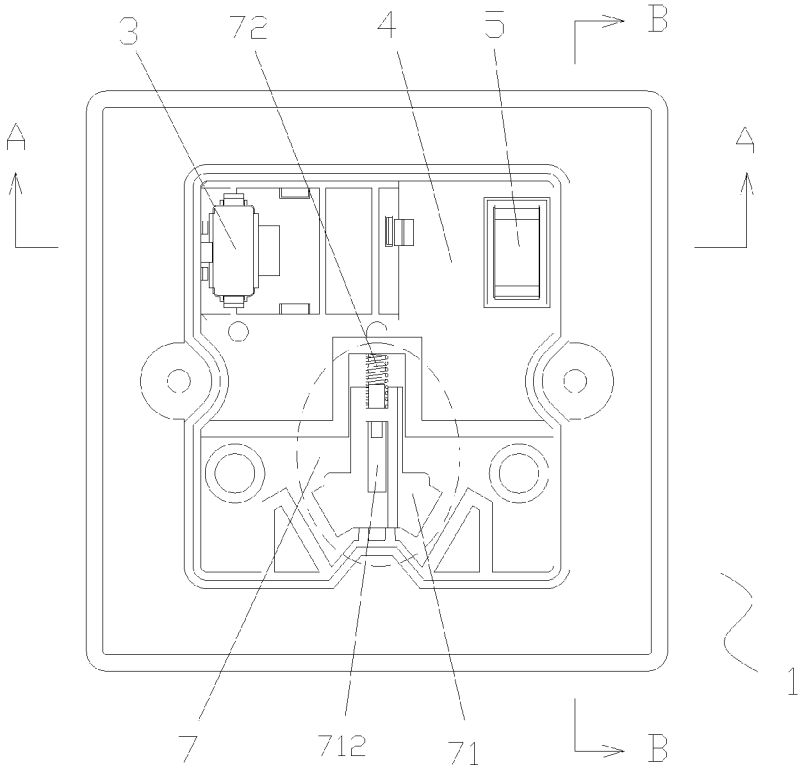
FIG. 3 is a schematic drawing for the internal structure of the claimed invention at the rear side.
Figure 10:
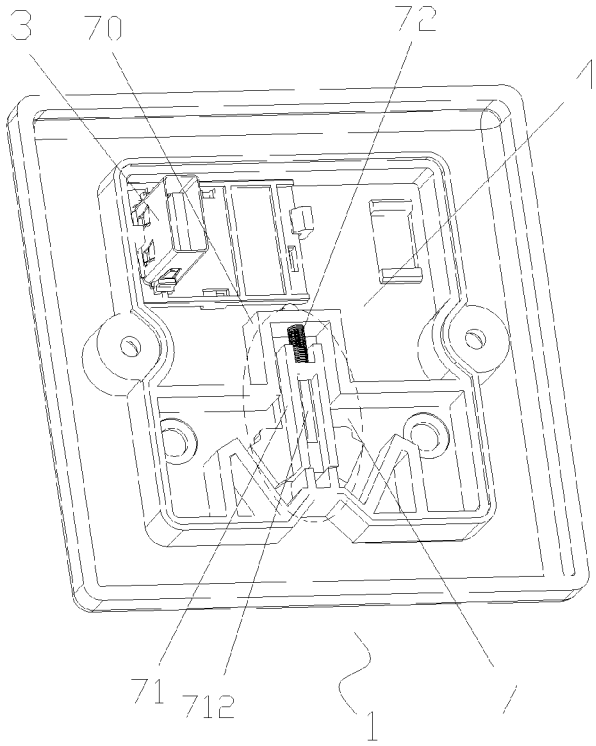
FIG. 10 is a three-dimensional schematic drawing of the rear side of the claimed invention (the second safety shutter is closed)
Figure 11:
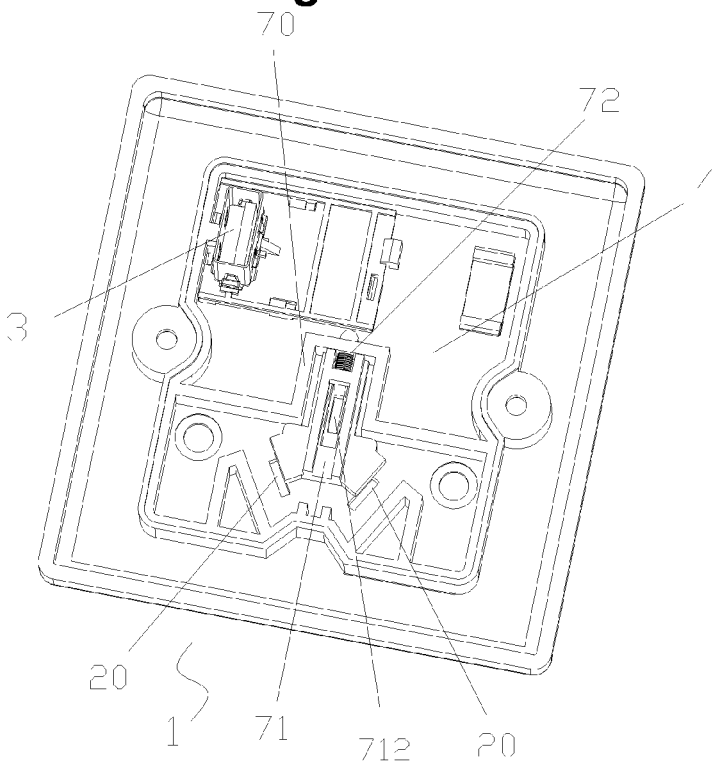
FIG. 11 is a three-dimensional schematic drawing of the rear side of the claimed invention (the second safety shutter is opened)

The following further describes the claimed invention in detail according to the figures and embodiments:

According to FIG. 2, FIG. 3, FIG. 4, FIG. 5, and FIG. 7, the claimed invention comprises socket cover 1. As shown in FIG. 2, a conventional power connector 2 and a USB port 3 are arranged on the socket cover 1. The conventional power connector 2 is used to connect to the AC line power. As shown in FIG. 3, FIG. 10 and FIG. 11, an AC-DC conversion module 4 is arranged in the socket cover 1. The input terminal of the AC-DC conversion module 4 connects to the AC line power. The output terminals of the AC-DC conversion module 4 connect with the USB port 3, connecting with a connection indicator light 5 in between.

Figure 4:
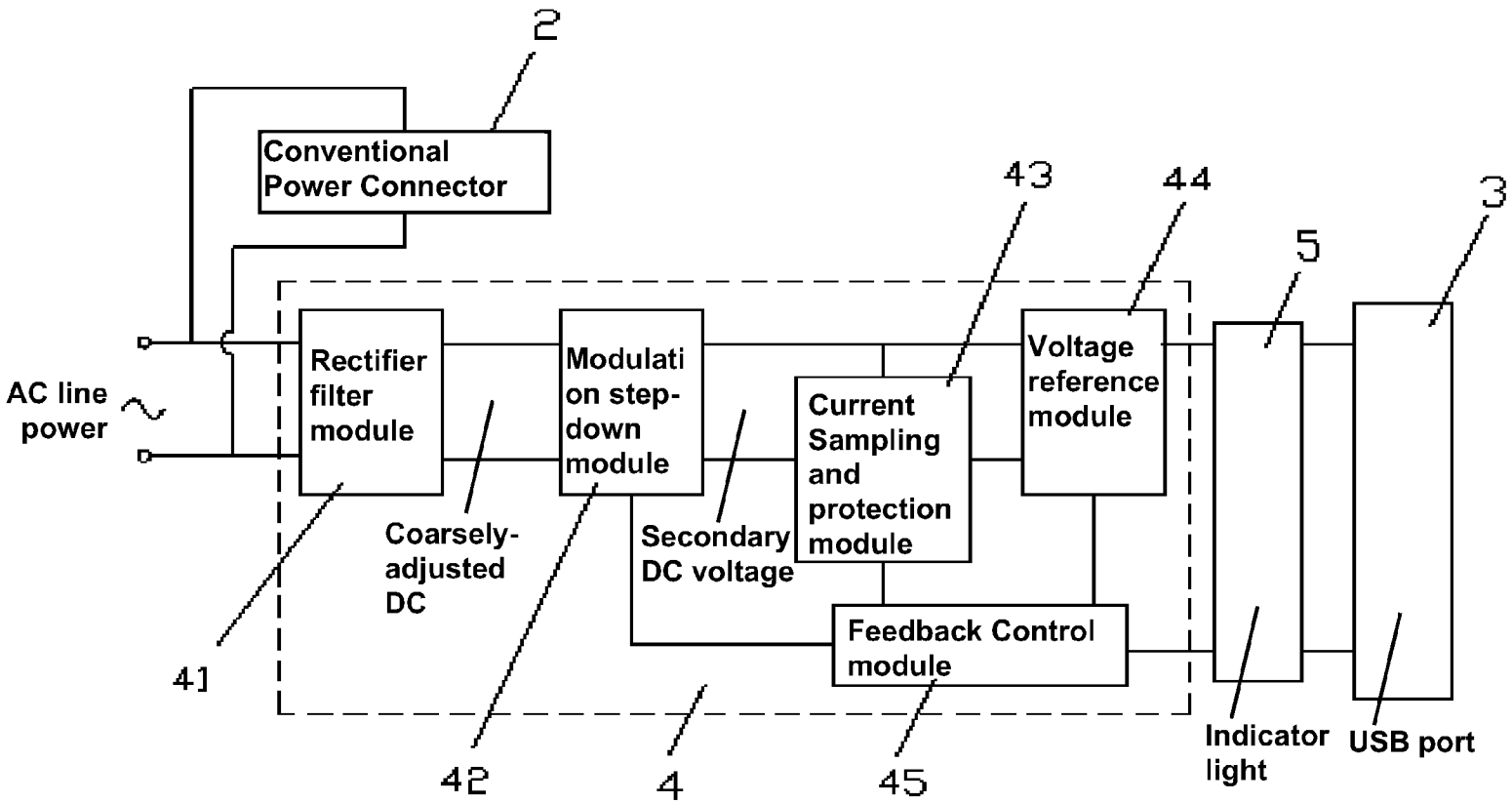
FIG. 4 is a drawing of a circuit connection principle of the claimed invention.

As shown in FIG. 4, the conventional power connector 2 directly connects to the AC line power, an AC-DC conversion module 4 including a safety module RF1 (not shown), a rectifier filter module 41, a modulation step-down module 42, a current sampling and protection module 43, a voltage reference module 44 and a feedback control module 45. The safety module RF1, the voltage reference module 44 and the feedback control module 45 are connected together in sequence. The current sampling and protection module 43 and the voltage reference module 44 and the feedback control module 45 are connected. The output of the feedback control module 45 connects to the modulation step-down module 42.

Figure 5:
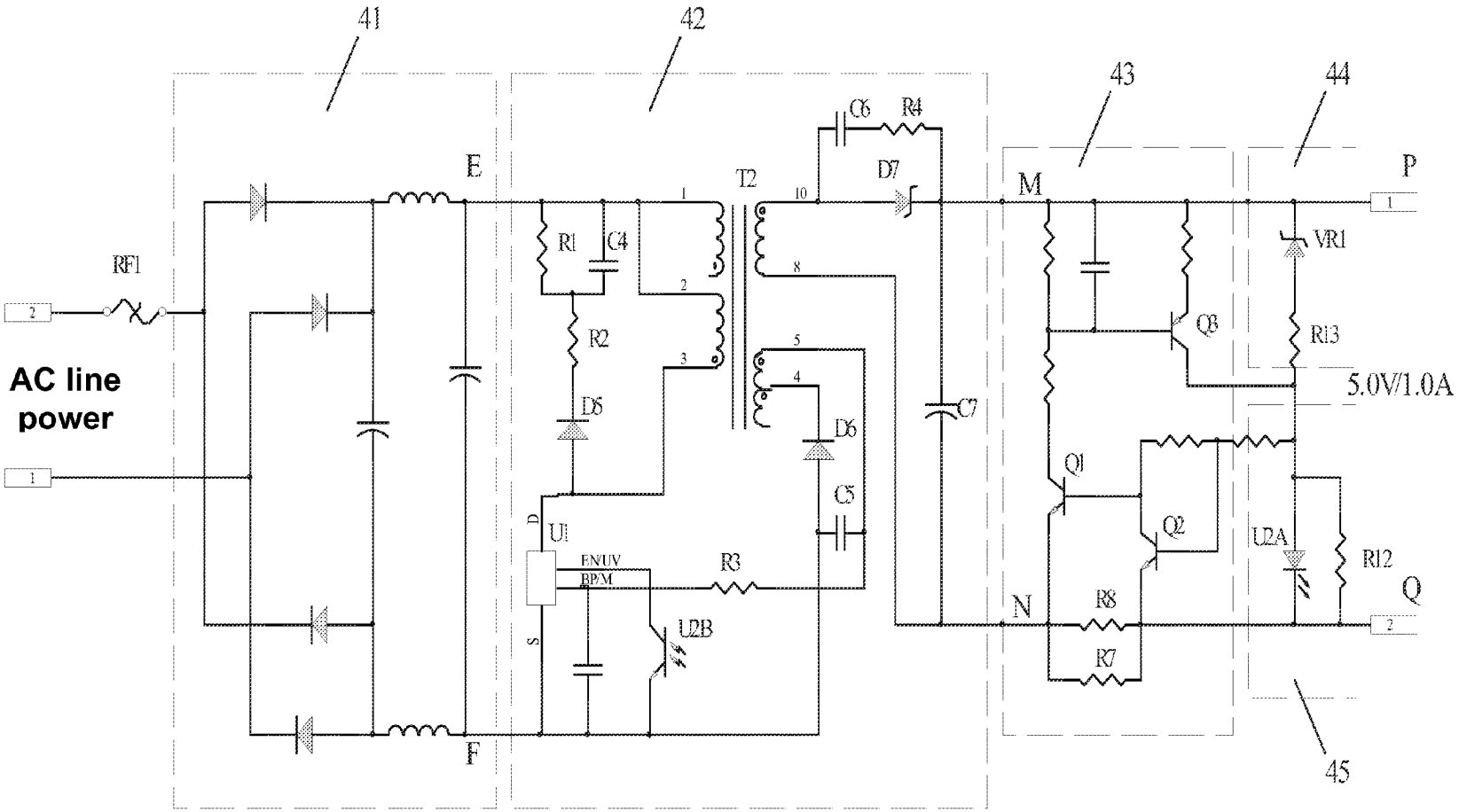
FIG. 5 is a schematic drawing for an AC-DC conversion module of the claimed invention.

As shown in FIG. 4 and FIG. 5, the rectifier filter module 41 performs rectification and filter processing on the AC input, generating a coarsely-adjusted DC output to the modulation step-down module 42. As shown in FIG. 5, the AC line power is input to the rectifier filter module 41 which outputs a coarsely-adjusted DC at terminal nodes E, F to the modulation step-down module 42 through a diode bridge rectifier, then through a LC filter.

As shown in FIG. 4 and FIG. 5, the modulation step-down module 42 generates the modulated signal through a transformer T2 and a pulse width modulation chip U1, output a secondary DC voltage to a current sampling and protection module 43 and voltage reference module 44 after rectification and filtering.

As shown in FIG. 5, the modulation step-down module 42 comprises a converter circuit, a freewheeling sub-module, a control sub-module and a secondary rectifier filter sub-module.

As shown in FIG. 5, the converter circuit comprises high frequency transformer T2 and its primary coils 2-3, and switching chip U1. The converter circuit converts the DC into a modulated AC, that is: DC current is applied from the positive terminal to the drain terminal D of the switching chip U1 (using TNY274P) through the primary coils 2-3 of the high frequency transformer T2. The DC current flows through the switch transistors in the U1, flowing out of the source terminal S of the switching chip U1 to the negative of the power source. The switch transistors in the switching chip U1 perform ON/OFF operations at a certain frequency. As a result, the primary coils 2-3 of the transformer T2 generate a pulse current which switches on and off, generating an alternating voltage with a certain amplitude in other coils of the transformer T2 through the electromagnetic induction of the transformer T2.

As shown in FIG. 5, the freewheeling sub-module comprises a freewheeling diode D5, a current limiting resistor R2, and a resistor R1 connected in parallel with a capacitor C4. When the switch transistor in the switching ship U1 is OFF, a back EMF (Electromotive Force) is generated in the primary coils T2. The back EMF through the freewheeling diode D5 and the current limiting resistor R2 forms a current loop together with a waveform adjustment circuit formed by a resistor R1 and a capacitor C4, providing a channel for release of electrical energy for the back EMF in the primary coils and providing electrical energy for the negative half cycle of a secondary coil.

As shown in FIG. 5, the control sub-module comprises a diode D6, a capacitor C5 and a resistor R3. The diode D6 and the resistor R3 are connected with the two terminals of the secondary coils 4, 5 of the transformer T2. The capacitor C5 is connected between the output terminals of the secondary coils 4, 5. The resistor R3 is connected with the BP/M terminals of the switching chip U1 (TNY274P).

The diode D6, the capacitor C5 and the resistor R3 provides a DC operation power supply to the switching chip U1. The size of the output voltage is controlled by an adjustment/differential signal coupled from optocoupler U2A, U2B (using PC817A). The ON/OFF duty cycle of the switch transistors in the switching chip U1 fulfills the functions of adjusting the voltage size and stabilizing voltage under the pulse width modulation mode (with constant switching frequency).

As shown in FIG. 5, a second rectifier filter sub-module comprises a half-wave rectifier circuit formed by a diode D7 and a capacitor C6, and a filter capacitor C7. The half-wave rectifier circuit is connected at the loop of the coils 8, 10 of the transformer T2. The filter capacitor C7 is connected in parallel with the two terminals of the secondary coils 8, 10, outputting a secondary DC voltage at terminal nodes M, N.

As shown in FIG. 4, the current sampling and protection module 43 obtains the loop current, and transmits the overcurrent signal to the feedback control module 45 to control the loop current parameters. The voltage reference module 44 transmits the voltage signal to the feedback control module 45. A DC voltage which is in conformity with the electrical parameters of the standard USB port 3 is output through the voltage reference module 44 and the feedback control module 45. The feedback control module 45 feeds back the current control signal and the voltage control signal to the modulation step-down module 42.

As shown in FIG. 5, the current sampling and protection module 43 comprises a sampling sub-module and a signal amplifier sub-module. The sampling sub-module includes a resistor R7 and a resistor R8. The signal amplifier sub-module is formed by connecting three transistors Q1, Q2, Q3 together. When there is over current, the voltage drop across resistors R7, R8 increase, Q2 cut off, Q1 and Q3 conduct. Excess current is transmitted to the feedback control module 45. The current control signal is fed back to the modulation step-down module 42 through the feedback control module 45, reducing the power voltage in order to obtain protection.

As shown in FIG. 5, when the voltage in the circuit increases, the voltage of the voltage reference module 44 remains unchanged and the current through the optocoupler U2A increases. Similarly, when there is over current, the current of the optocoupler U2A increases. The coupling signal through the optocoupler U2A is transmitted to the EN/UV terminals of the switching chip U1 to control the duty cycle of the pulse width modulation so that the voltage in the circuit is reduced to achieve the feedback control for stabilizing current, stabilizing voltage.

As shown in FIG. 2, FIG. 3 and FIG. 4, an indicator light 5 is arranged on the socket cover 1. The indicator light 5 shows the working status of the AC-DC conversion module 4.

Figure 6:
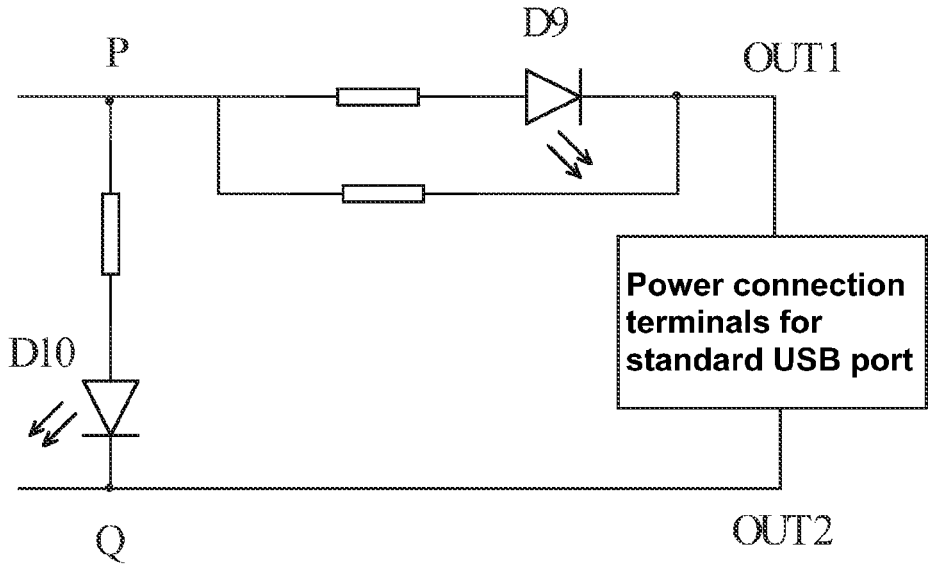
FIG. 6 is a schematic drawing for a circuit connection of the indicator lights.

As shown in FIG. 6, the indicator light 5 includes light emitting diodes D9, D10. The light emitting diode D9 can emit red light, and is connected in parallel between the output terminals P, Q of the AC-DC conversion module 4. The light emitting diode D10 can emit green light and is connected in series to the output loop of the AC-DC conversion module 4 and the standard USB port 3. In this way, the output terminals OUT1, OUT2 and the power connection terminals of the standard USB port 3 are directly connected.

When the AC-DC conversion module 4 conducts with the AC line power, the light emitting diode D9 stays on, indicating the power output is normal.

When an electrical appliance is plugged into the USB port 3 to start charging, the light emitting diode D10 is switched on. The light emitting diode D10 gradually dims as the charging current becomes gradually less, and is switched off when the electrical appliance is fully charged.

Figure 7:
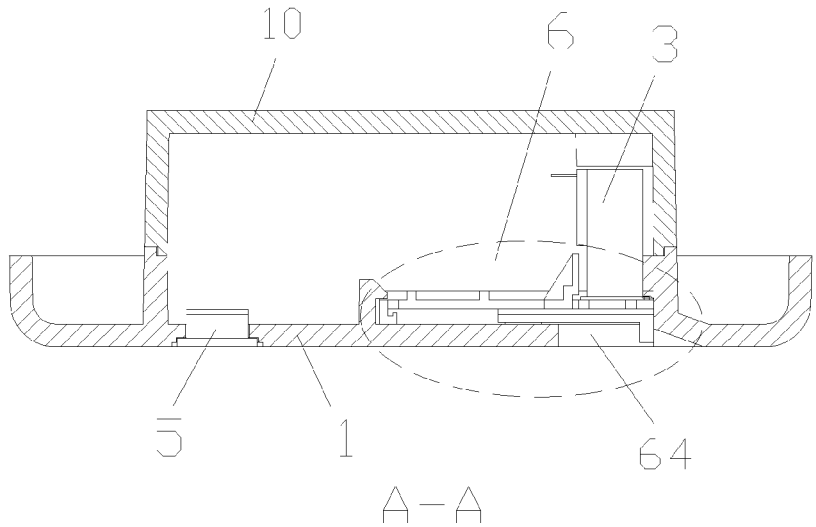
FIG. 7 is a schematic drawing for a cross-section along A-A of the rear side of the claimed invention.
Figure 9:
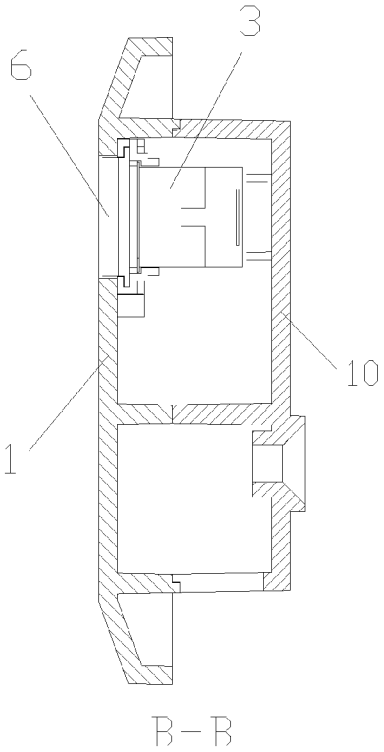
FIG. 9 is a schematic drawing for a cross-section along B-B of the rear side of the claimed invention.

As shown in FIG. 2, FIG. 7 and FIG. 9, a first safety shutter 6 is arranged at the USB port 3 on the socket cover 1. The rear of the socket cover is equipped with a rear cover plate 10.

Figure 8:
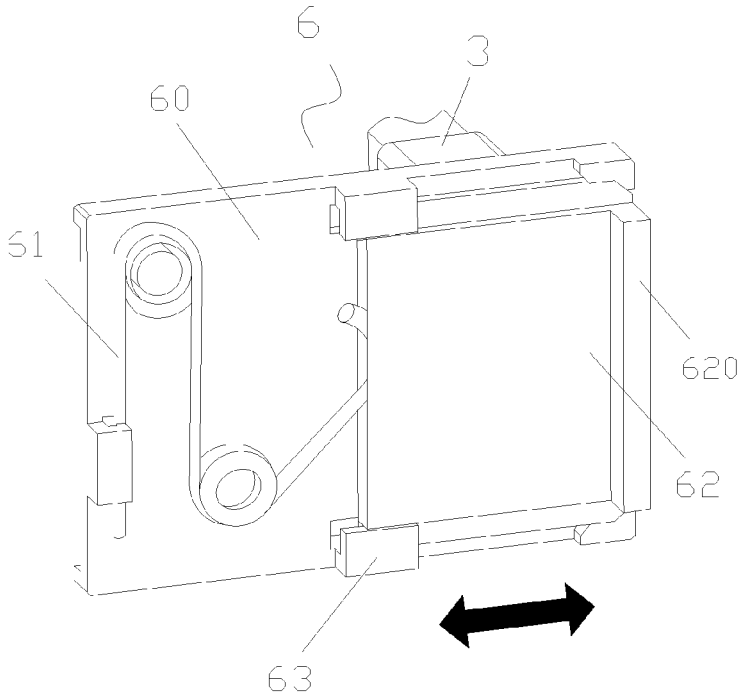
FIG. 8 is a schematic drawing for a first safety shutter.

As shown in FIG. 7 and FIG. 8, the first safety shutter 6 comprises a base 60, a bow-shaped spring 61, a slide cover 62 and a pair of inwardly concave grooved blocks 63, and, as shown in FIG. 8, a USB slot 64 is opened on the surface of the socket cover 1.

As shown in FIG. 7, the USB port 3 is installed on the base 60. The base 60 is mounted in the socket cover 1. The inwardly concave grooved blocks 63 are arranged on both sides of the base 60. The slide cover 62 is clamped between the two inwardly concave grooved blocks 63. The bow-shaped spring 61 is secured on the side of the base 60 with it tip pushing against the side end of the slide cover 62. The external end of the slide cover 62 is attached with a stopper bar 620. The stopper bar depends against the edge of the USB slot 64. As shown in FIG. 7, the USB slot 64 corresponds to the locations of the USB port 3 and the slide cover 62.

As shown in FIG. 7 and FIG. 8, the usage of the first safety shutter 6 is as follows:

Lift the stopper bar 620→slide cover moves against the bow-shaped spring 61→the first safety shutter 6 opens→the USB plug of an electrical appliance is inserted into the USB port 3→charging→when charging is complete, remove the electrical appliance→the elastic restoring force of the bow-shaped spring 61 is applied to the slide cover 62→slide cover 62 returns to the edge of the USB slot 64→the first safety shutter 6 is closed As shown in FIG. 3, FIG. 10 and FIG. 11, a second safety shutter 7 which can be opened or closed is arranged in a conventional power connector 2 in the socket cover 1. The safety shutter 7 comprises a slide 71 corresponding to the earth hole of the conventional power connector 2, and a linear spring 72 arranged against the slide 71.

As shown in FIG. 3, FIG. 10 and FIG. 11, a opening 712 is provided in the middle of the slide 71. The opening 712 corresponds to the earth hole of the conventional power connector 2. The slide 71 can block the live holes of the conventional power connector 2. After an external pin is inserted the earth hole and the opening 712, the slide 71 displaces laterally away from the location of the live holes.

Figure 12:
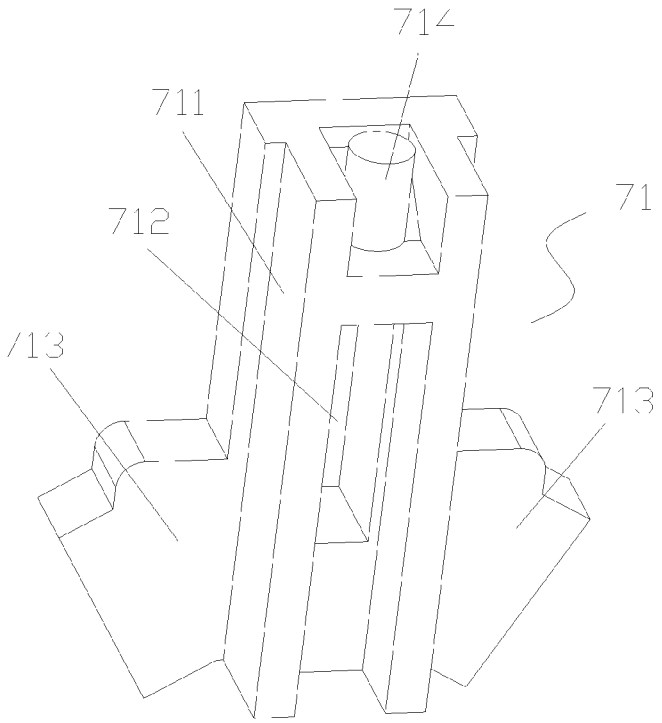
FIG. 12 is a schematic drawing for the slide of the claimed invention.

In particular, as shown in FIG. 12, the slide 71 comprises a main body 711.

As shown in FIG. 12, a oblique opening 712 is provided in the middle of the main body 711. The opening 712 overlaps with the earth hole of the conventional power connector 2.

As shown in FIG. 12, one end of the main body 711 has a protruding rod 714. The linear spring 72 is fitted onto the protruding rod 714. As shown in FIG. 10 and FIG. 11, the internal end of the linear spring 72 pushes against a depression slot 70 in the socket cover 1.

As shown in FIG. 12, another end of the main body 711 is attached with wings 713 at both sides. The two wings 713 are respectively located at the two live holes of the conventional power connector 2. The stopper is arranged in the socket cover 1 to stop the wings 713.

As shown in FIG. 11 and FIG. 12, the usage of the second safety shutter 7 is as follows:

When there is no action of foreign material (that is when the safety shutter 7 is in its closed position), the wings 713 block the two live holes of the conventional power connectors 2→because the earth pin is longer than the live pins in the external plug, the earth pin enters into the earth hole of the conventional power connector 2 first during insertion→the earth pin touches the oblique opening 712→the perpendicular force of the insertion generates a horizontal vector→compelling the main body 711 to move towards the linear spring 72→wings 713 depart from the location of the live holes of the conventional power connector 2 so that the second safety gate 7 is in an open state→the live pins of the external plug are inserted into the live holes of the conventional power connector 2→remove the external plug after use→Under the restoring action of the linear spring 72, the main body 711 returns to its initial position, with wings 713 blocking the two live holes of he conventional power connector 2 thus restoring the closed state of the safety shutter 7).

Figure 13:
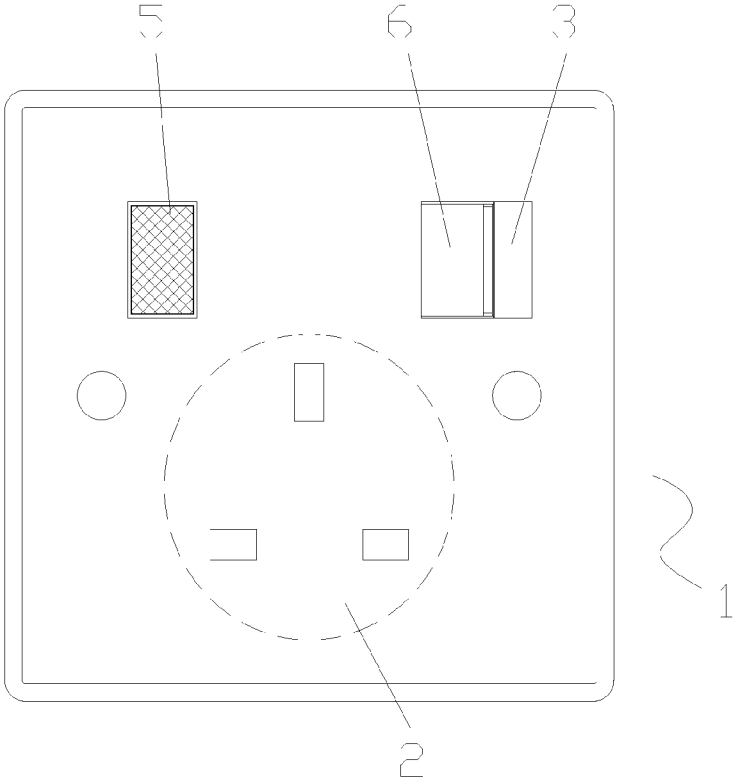
FIG. 13 is a schematic drawing for the design of another connector application of the claimed invention.

When compared with FIG. 2, the differences in the drawing for a design of another type of connector as shown in FIG. 13 are just certain differences in the shape of the connectors. It is similar to the aforesaid embodiments in term of basic structures, principles, methods which will not be redundantly repeated here.

In conclusion, the basic structures, principles and control methods of the invention are specifically described through the above embodiments. Under the hypothesis of not deviating from the main ideas of the claimed invention, the person skilled in the art can implement various variations/alternate forms or combinations without carrying out any inventive work.

We claim:

1. A multifunctional wall socket for mounting in a wall and wired to conventional AC line power, the wall socket having a socket cover, the socket cover having a conventional power connector positioned therein, said conventional power connector being connectable to AC line power, and a USB port is further arranged in said socket cover, an AC-DC conversion module is arranged in said socket, an input terminal of the AC-DC conversion module is connected to the AC line power, an output terminal thereof is connected to the USB port, outputting DC power and wherein said AC-DC conversion module includes a rectifier filter module, a modulation step-down module;

a current sampling and protection module;

a voltage reference module and a feedback control module, the rectifier filter module and the modulation step-down module being connected in sequence;

the current sampling and protection module and the voltage reference module being connected to the feedback control module, the output of the feedback control module being connected to the modulation step-down module, wherein, said rectifier filter module performs rectification and filter processing on the AC input, generating a coarsely-adjusted DC to output to the modulation step-down module;

said modulation step-down module generates a modulation signal through a transformer and a switching chip, outputting a secondary DC voltage to the current sampling and protection module and the voltage reference module after rectification and filtering;

said current sampling and protection module acquires a feedback current, and transmits an over-current signal to the feedback control module, to control the parameters of the feedback current;

said voltage reference module transmits a voltage signal to the feedback control module, outputting a DC voltage in conformity with the electrical parameters of a standard USB port through the voltage reference module and the feedback control module;

said feedback control module feeds back current control signal and voltage control signal to the modulation step-down module.

2. The multifunctional wall socket according to claim 1 wherein:

an indicating light is further arranged on said socket cover, said indicating light shows the working status of said AC-DC conversion module.

3. The multifunctional wall socket according to claim 1 wherein:

a first safety shutter which can be opened or closed is arranged at the USB port on said socket cover.

4. The multifunctional wall socket according to claim 3, wherein:

said first safety shutter includes a base, a bow-shaped spring, a slide cover and a pair of inwardly concave grooved blocks corresponding to the slide cover, and a USB slot is opened on the surface of the socket cover, wherein, the USB port is installed on said base, said base is mounted in the socket cover;

said inwardly concave grooved blocks are arranged at two sides of the base, the slide cover is clamped between the two inwardly concave grooved blocks;

said bow-shaped spring is secured at the sides of the base with a tip thereof pushing against a side end of the slide cover;

said USB slot corresponds to the location of the USB port and the slide cover.

5. The multifunctional wall socket according to claim 4, wherein:

a stopper bar is attached outside an end of said slide cover, said stopper bar depends against the edge of the USB port.

6. The multifunctional wall socket according to claim 1, wherein:

a second safety shutter which can be opened or closed is arranged at the conventional power connector in said socket cover.

7. The multifunctional wall socket according to claim 6, wherein:

said second safety shutter includes a slide corresponding to the earth hole of the conventional power connector, and a linear spring pushing against the slide, wherein, an opening is provided in the middle of said slide, the opening corresponding to the earth hole of the conventional power connector;

said slide can block the live holes of the conventional power connector;

said slide displaces laterally after an external pin is inserted into the earth hole and the opening, departing from the location of the live holes.

8. The multifunctional wall socket according to claim 7, wherein:

said slide having a main body, wherein, an oblique opening is provided in the middle of said main body;

a protruding rod is attached at an end of said main body, said linear spring is fitted onto the protruding rod;

a wing is attached at both sides of another end of said main body, said two wings are positioned at the two live holes of the conventional power connector.

* * * * *